US005544973A

United States Patent [19]

Frizell et al.

[11] Patent Number: 5,544,973

[45] Date of Patent: Aug. 13, 1996

[54] CONCRETE STEP EMBANKMENT PROTECTION

[75] Inventors: Kathleen H. Frizell, Arvada; Brent W. Mefford, Lakewood; Tracy B. Vermeyen, Denver, all of Colo.; Douglas I. Morris, Woodside, Calif.

[73] Assignee: The United States of America as represented by the Secretary of the Interior, Washington, D.C.

[21] Appl. No.: 403,606

[22] Filed: Mar. 14, 1995

[51] Int. Cl.[6] ..... E02B 3/12

[52] U.S. Cl. ..... 405/16; 405/21

[58] Field of Search ..... 405/15, 16, 17, 405/18, 20

[56] References Cited

U.S. PATENT DOCUMENTS

| | | | |
|---|---|---|---|
| 1,561,796 | 11/1925 | Rehbock | 405/108 |
| 2,171,560 | 9/1939 | Holmes | 405/81 |
| 3,347,048 | 10/1967 | Brown et al. | 405/16 |
| 3,854,291 | 12/1974 | Perkins | 405/108 |
| 4,352,593 | 10/1982 | Iskra et al. | 405/108 |
| 4,813,812 | 3/1989 | Hasegawa et al. | 405/16 |

OTHER PUBLICATIONS

US Dept. of Interior, Bureau of Reclamation, "Design of Small Dams", Third Edition, 1987, Water Resources, pp. 347 to 364.

*Primary Examiner*—David J. Bagnell
*Assistant Examiner*—Tara L. Mayo
*Attorney, Agent, or Firm*—E. Philip Koltos

[57] ABSTRACT

A dam spillway system for embankment dam overtopping protection comprising a layer of free-draining, angular, gravel filter material, a plurality of rows of overlapping, tapered, concrete blocks assembled over the filter material in shingle-fashion, from the toe of the dam, up the slope to the top of the dam, and a plurality of fixed concrete toe blocks located at the toe of the dam, usually beneath the tailwater, and supporting each of the rows of concrete blocks.

11 Claims, 3 Drawing Sheets

CONCRETE STEP EMBANKMENT PROTECTION

BACKGROUND OF THE INVENTION

1. Field of the Invention

This invention relates in general to spillways of hydraulic structures and more specifically to concrete step overlay protection for embankment dams.

2. Prior Art

Known in the art are dam spillways made in the form of open or closed channels communicating the reservoirs upstream and downstream of the dam and provided with water flow kinetic energy dissipators. Many attempts have been made to protect civil structures constructed of earth materials from erosion, whether the structures be a canal, waterway, or dam. Protection systems used on dams include grass linings, riprap, geotextiles and underlying grids, gabions, concrete block revetment systems, soil cement, and thick roller compacted concrete. These systems have been tested and used at various sites, but each has disadvantages or limitations.

Grass linings must have well established, uniform vegetative cover, which limits use in some climates. Unit discharges on 2.5:1 slopes are limited to less than 6.6 $ft^3/s/ft$, and on 20:1 slopes to 20 $ft^3/s/ft$. Small irregularity in the vegetative cover greatly increases the erosion or failure potential.

Scale model testing has been done on riprap to determine the stability of riprap on slopes up to 5:1. This modeling has shown that riprap scaled to represent 6-to 24-inch diameter rock, was suspended and washed downstream under the scaled unit discharge of 40 $ft^3/s/ft$. No analytical method is available to accurately predict the behavior of riprap protection with enough confidence to recommend its use as protection from overtopping flows of any significant magnitude.

Geotextiles, both with and without cover, and grids filled with gravel, placed on slopes from 2:1 to 4:1, were tested to failure, in large facilities, at unit discharges of 25 $ft^3/s/ft$ and velocities about 22 ft/s. Failure occurred due to poor anchorage or stretching of the material.

Gabions are wire baskets filled with rock and anchored to slopes for erosion protection. They may perform well if anchored properly, but do undergo considerable deformation under flow conditions. Gabions should only be used up to tested velocities of 24 ft/s.

Concrete block revetment systems are generally cable-tied together, with grass cover over the voids, and anchored to the embankment. Two systems have been tested and are in use for overtopping protection, but may not be considered for velocities exceeding the test velocity of 26 ft/s. Simple concrete construction blocks filled with gravel have been used successfully up to velocities of 22 ft/s.

A wedge shaped concrete block was developed by Professor Yuri Pravdivets of the Moscow Institute of Civil Engineering in Russia. This block has been tested extensively, but is designed based upon block thickness vs. unit discharge. This leads to overdesign of the block based upon the test results of the instant invention.

Soil cement and roller compacted concrete (RCC) have proven to be very effective in protecting against erosion, however, their protection comes from the thickness of the concrete overlay alone. Applications are widespread but rely on the strength of the material and the cover thickness to provide protection. Subjecting the materials to high velocity flows would likely degrade the protective system. These techniques are economical only with placement of large quantities of material and require easy site access and may significantly impact the surrounding environment. The Russian block concept does not include interlocking pins which prevent buckling failures noted in European tests of the Russian design under some flow conditions.

Several prior art systems concerned with spillway design are available. U.S. Pat. No. 1,561,796 to Rehbock discloses a low, roof-shaped sill formed integrally with an apron. The sill is on the upstream side of its upper face and is provided with a series of teeth with a vertical upstream face and a gently sloping downstream face. The rapidly flowing part of the stream in the vicinity of the bed is gently deviated upwards by means of the toothed sill. The gently ascending streams of water flowing through the gaps between the teeth, prevent the main current from descending too rapidly to the bed and from affecting the ground.

U.S. Pat. No. 2,171,560 to Holmes discloses a method for fishway collection systems. U.S. Pat. No. 3,854,291 Perkins discloses a self cleaning filter for hydrological regeneration. The invention provides for a plurality of holding dams mounted in a stream and in which each holding dam is formed with a filter portion which receives the principle polluted liquid carried by water tight sewage conduits. The downstream side of the wall is provided with aeration troughs for adding air to the liquid as it flows past the dam.

U.S. Pat. No. 4,352,593 to Iskra et al discloses a dam spillway to pass water over the crest from a forebay into an afterbay and comprises a mixing chamber communicating with a diffuser, said mixing chamber has an intake arrangement ensuring formation downstream of the diffuser of a flotation zone with a froth collector installed at the end, the intake arrangement includes a water flow divider, a water breaking grid and air intake ducts, the divider being installed above the chamber and made in the form of a screen composed of chutes, the water grid of the intake arrangement composed of bluff members is provided in the inlet portion of the chamber, the air intake ducts of the intake arrangement are made in a wall of the mixing chamber below the grid in close proximity thereof.

There are several manufacturers of other types of concrete block revetment systems (Armorflex, Petraflex, Tri-Lock, etc.) that have limited applicability for dam overtopping protection. Most of these systems were designed to prevent river bank erosion.

In summary, the applicability of other known embankment protection systems are limited to providing erosion protection against low velocity flows, or flatter slope applications, or utilize mass concrete placement. The other known art most similar to the instant invention is the Russian wedge-shaped block design which has a fixed shape that does not serve to optimize block stability or energy dissipation of the flow.

SUMMARY OF THE INVENTION

The invention has particular application to providing erosion protection for embankment dams that may be subject to overtopping flows. The principal utility of the invention is to provide erosion protection from high velocity flows. The block shape uses the hydraulic forces to enhance its stability, thus greatly improving the protection provided and velocity range of application. The general field of application is in civil works where primarily earth and rockfill dams or embankments of slopes as steep as 2:1 (H:V) would be allowed to pass flows over the downstream face by virtue of the protection provided by the invention. Providing protection for an embankment dam is more challenging due to the erosive nature of the earth materials.

Primary importance for embankment dam overtopping protection is placed upon the stability of the protective overlay. Should the overlay become unstable or fail, then the embankment would be quickly susceptible to erosion and subsequent failure. The concrete step shape, regardless of the construction technique, provides a proven, stable, protective overlay. The stability of the stepped concrete overlay is enhanced by providing continuous aspiration of subgrade seepage by virtue of the flow characteristics over the stepped surface. Aspiration is suction of the fluid from underneath the overlay. Suction is produced by the pressure differential created by the high velocity flow over the step offset area. The unique step geometry of the invention produces a zone of subatmospheric pressure to relieve buildup of seepage pressure under the overlay. Water pressure buildup, whether from the saturated embankment or the flow over the steps, that will force the protective surface to uplift, is the most common method of failure. Pressure buildup is naturally relieved by the low pressure zone at the base of each step caused by flow over the step shape of the invention. In addition, the impact on the downstream edge of the step shape increases the stability by providing additional downward force when added to the flow depth.

Of secondary importance is the energy dissipated by the step shape as the flow travels down the slope. Stepped spillways for steep roller compacted concrete (RCC) dams have shown great reduction in flow velocities at the dam toe, compared to smooth spillway surfaces. This results in significant cost savings in the energy dissipator structure. The step shapes developed for embankment dams do not provide as great a reduction in energy, by virtue of the sloping top surface, but do reduce the velocities over those associated with a smooth spillway, thus producing cost savings.

The block shape design criteria of the invention provides optimum hydraulic stability and energy dissipation of the overriding flow at a minimum block mass. The invention has been tested in a large prototype test facility with a 2:1 slope up to unit discharges of 32 $ft^3/s/ft$ and velocities of 45 ft/s. This far exceeds the proven capability of any other product on the market that also provides overtopping protection.

BRIEF DISCUSSION OF THE DRAWINGS

DESCRIPTION OF THE PREFERRED EMBODIMENTS

Figure 1:
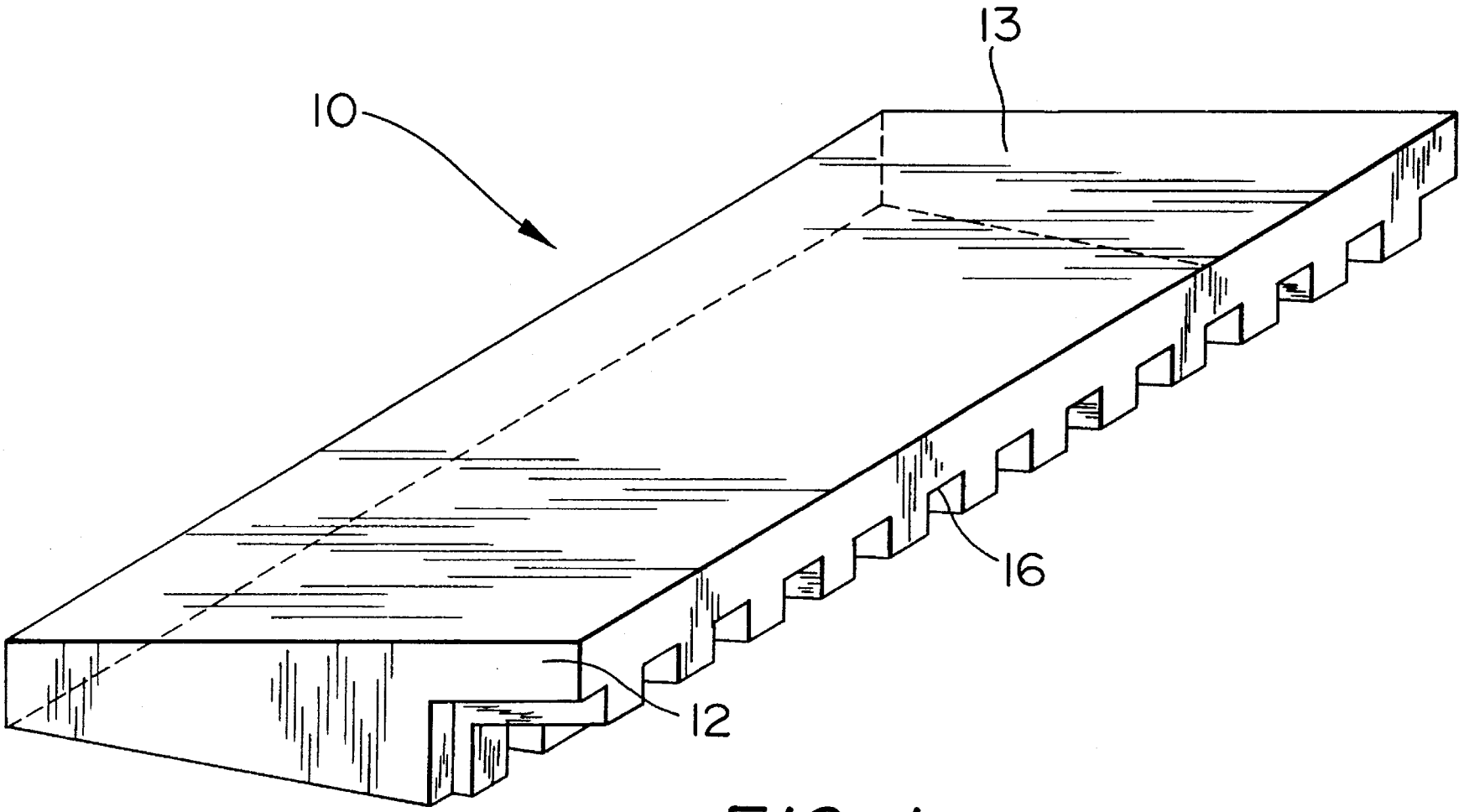
FIG. 1 is a top perspective view of a concrete step block in accordance with the invention.
Figure 2:
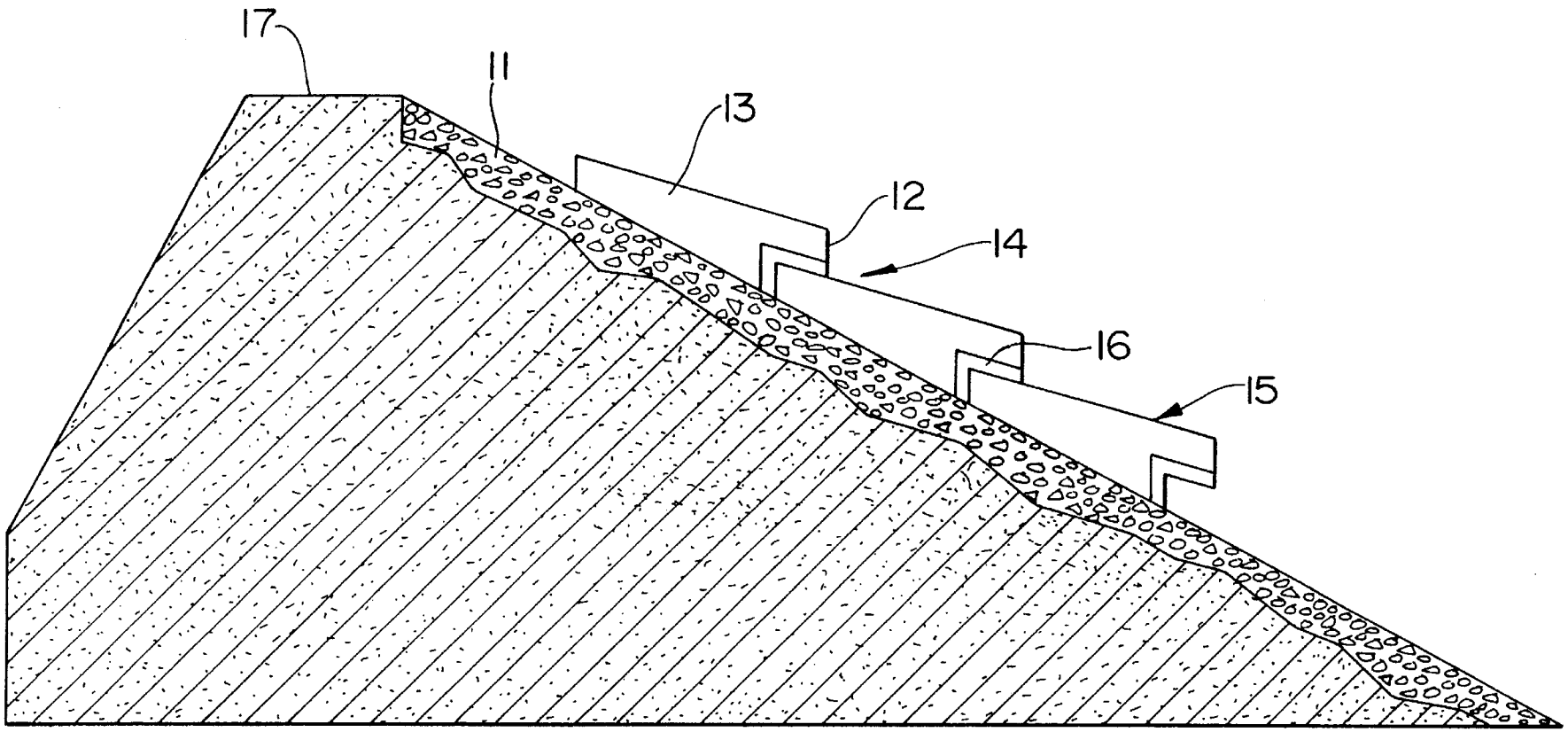
FIG. 2 is a schematic view of a preferred embodiment of the invention.

The invention concerns a stepped spillway comprising overlapping, tapered, generally rectangular shaped concrete blocks 10 (see FIG. 1). As shown in FIG. 2, the blocks 10 are placed over free draining, angular, gravel filter material 11. Each of the step blocks 10 in an assembly, has a step height 12, a sloping top surface 13 (degrees below horizontal), a step offset area 14, an impact area 15, and vents 16 for aspiration of uplift pressure.

In FIG. 2, the tread slope is about 15° and the embankment slope is about 2:1. The tread slope, i.e., the slope on the top surface 13 of the block 10, can be varied in relation to the embankment slope as specified by the design guidance for steep embankments. In particular, to design for different embankment slopes, the tread slope of surface 13 of block 10 is changed such that it is equal to the embankment slope minus 11 degrees. This is done by keeping the step height 12 constant and varying the top sloping surface 13 in relation to the embankment slope.

Figure 3:
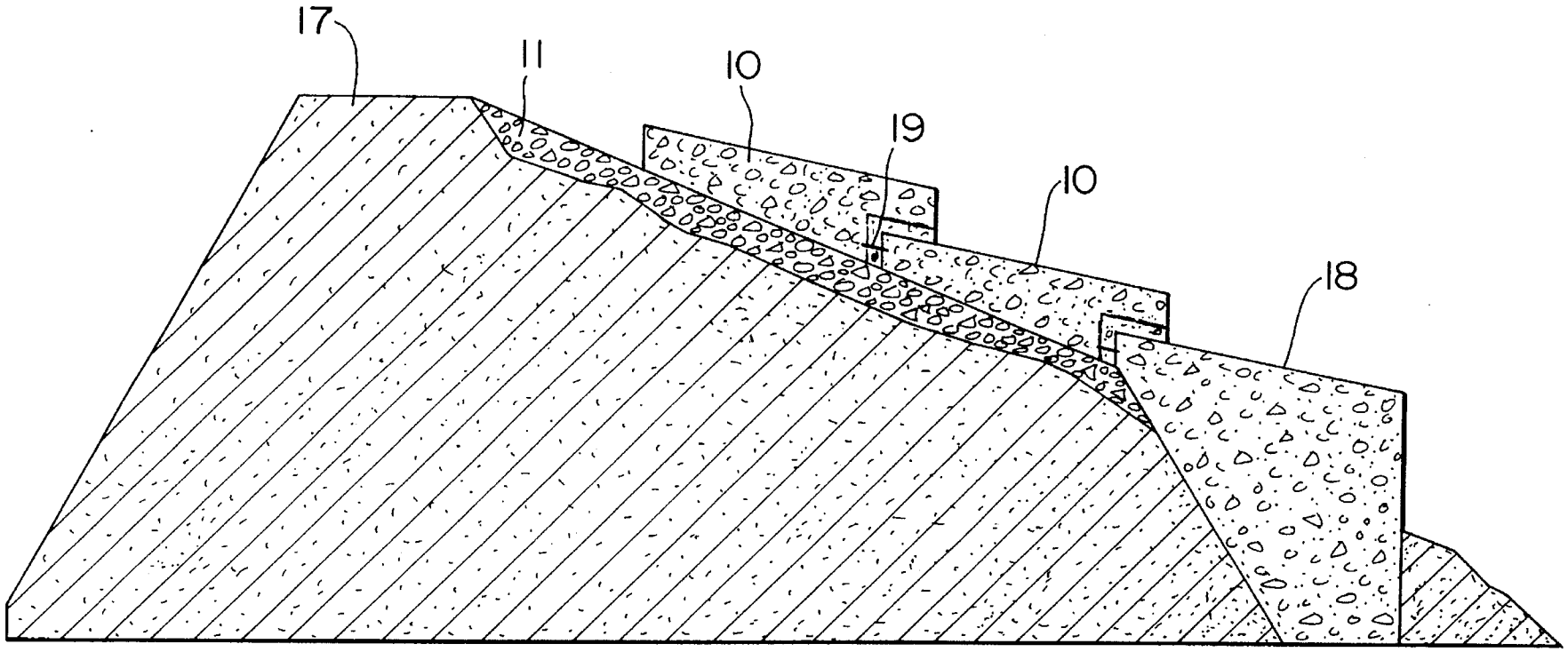
FIG. 3 is a schematic view of a toe block and example of a block pattern on a different slope.

An additional alternative, shown in FIG. 3, includes embedding connection pins 19 longitudinally between blocks 10 and a toe block 18. Connection pins 19 are designed to inhibit buckling-type failures and toe block 18 is required for stability at the toe of the slope. Pins 19 are specified whenever the blocks 10 are likely to be submerged by a hydraulic jump. The toe block 18 (key) is used as a base for the first row of overlapping blocks and continues completely across the spillway width at the toe of the dam. Blocks 18 located beneath the tailwater should be cast with two holes per block to receive the loose fitting connection pins 19.

The 15° step top slope or tread slope of top surface 13 on the 2:1 embankment slope provides the optimum stability (FIG. 2). A horizontal top surface 13, produces the most energy dissipation. Each of the shapes shown in FIGS. 1 to 3 or a horizontal top surface, has their advantages and may be used in the design of a protective system for an embankment. The 15° sloping step block 10 was chosen to test in the prototype facility because stability is the most important item in an embankment protective system.

Based on prior laboratory studies, the overlapping, tapered, concrete blocks shown in FIG. 1 were designed and constructed for large scale tests. The blocks 10 were 1.23 ft-long, and 0.21 ft-high with a maximum thickness of 0.375 ft. Vents 16, which aspirate water from the filter layer 11 are formed in the overlapped portion of the block 10. The blocks 10 were placed over 0.5 ft of free-draining, angular, gravel filter material 11. The filter material 11 and thickness were designed according to Bureau of Reclamation design guidelines. The gravel filter 11 was placed on the concrete floor with 4-inch angle iron (with a gap above the floor to allow free discharge underneath) placed every 6-ft up the slope to prevent sliding of the gravel filter material 11. A wooden strip was installed along each wall to easily screen the gravel filter material 11 and to prevent failure along the wall contact during operation. A combination of 2-ft and 1-ft-wide blocks were placed on the embankment shingle-fashion from the slope toe leaving no continuous seams in the flow direction.

At the crest 17, of the structure, a small concrete cap (not shown) was placed to transition from the flat approach to the first row of blocks. At the toe of the concrete slope is a fixed concrete end block to support the blocks 10 up the slope. About every twenty fifth row of blocks 10 was anchored to the floor to prevent gradual migration of filter material 11 which could result in bowing or settling of the block 10 overlay. Where the blocks 10 will be under the tailwater at the toe of the slope, the blocks 10 are pinned together longitudinally through the overlapping area parallel to the slope.

During initial startup of the flume, under a very low discharge, the fines and dirt were flushed from the filter material. Flushing lasted a very short time and was observed by the coloring of the water. After shutting off the water, slight settling of the blocks was apparent; however, there was no sliding or noticeable trend to the settling. Throughout the testing, no further settling of the blocks 10 occurred. The maximum settlement was about 1 inch. The blocks 10 were exposed to two winters of freezing conditions with no measurable movement or damage.

The discharge coefficient for an overtopping embankment dam is a function of the upstream slope of the dam, the top width, and the abutment geometry (for short crest lengths), and varies with the overtopping head. An average coefficient of about 2.9 may be used for most flood routing applications to determine the depth of overtopping that will pass the desired Probable Maximum Flood (PMF).

The most stable block shape on a 2:1 slope is the 15° tapered or sloping block 10. The percent of the vertical block 10 face area occupied by the vents 16 should be 2.8%. This block 10 shape was tested in a large-scale facility for unit discharges up to 32 $ft^3/s/ft$. Greater top slopes may produce instabilities by providing too large a low pressure zone or too small of a solid vertical block surface. Any block design is based upon keeping the difference between the top slope and the embankment slope constant for a given embankment dam slope. Therefore, with a block with a top slope that provides effective aspiration, the difference between the slope is 11.56° (embankment slope=26.56° (2:1) minus top slope=15°).

In addition, the ratio of the step height to the step tread length exposed to the flow should remain between four and six. If the step height is chosen to match that of our testing, 2.5 in, then the tread length should optimally be chosen to match as well. This would produce slightly different horizontal tread lengths for dams of different slopes based upon the chosen top slope of the block. This horizontal tread length is then used to determine the length of the block surface along the embankment slope.

The block 10 thickness is determined from the stability analysis. A minimal thickness of 2 inches at the upstream end of the block is required to maintain the integrity of the concrete and allow proper forming of the block 10.

The question of stability of the protective system is the most critical for an embankment dam. Any failure or instability in the system could cause a catastrophic failure of the entire dam during an overtopping event. Laboratory data shows that the ability of the blocks 10 to relieve the uplift pressure, combined with the impact of the water on the block surface, make the blocks 10 inherently stable. The 15° sloping block 10 was used for the large scale tests.

Pressure data were gathered to compute the magnitude of the forces acting on the block surfaces and in the underlying filter 11. For discharges producing skimming flow, impact pressures increase to a maximum about 44 steps down the slope, then decrease due to aeration effects. The filter 11 pressures were assumed to vary linearly between the measurement locations. The filter 11 pressures show a gradual increase over about the top 40 steps, indicating a buildup of flow in the filter near the top of the slope. At about 45 steps down the slope, the filter pressures quickly decrease as aspiration increases to an average of about 0.1 ft at the toe of the slope for all flow rates.

The stability of the block system has been analyzed as a function of the total forces acting on individual blocks 10 down the slope. Block 10 weight and pressure yield a net downward or positive force normal to the slope. The uplift pressure in the filter material 11 underneath the block 10 and the low pressure zone created by the block offset act in an upward (negative) direction tending to lift the blocks from the embankment surface. Aspiration ports, vents 16 in the vertical face of the block 10 limit the uplift forces by venting the filter layer 11 to the low pressure separation zone, step offset area 14. The gradation of the filter material 11 must be designed to prevent the filter material 11 from being transported through the aspiration ports, vents 16. In the analysis, a net positive force indicates a stable block 10.

Ports, vents 16, for providing aspiration of filter pressures should be 2.8% of the surface are of the step 12. Proper sizing of the port area will limit the uplift pressure developed in the filter layer 11. The length of blocks 10 used across the width of the dam will also influence the amount of flow entering the filter 11. Using longer blocks across the dam width will reduce the jointing, thus the infiltration of flow to the filter layer 11. If excessive seepage is expected, then the block weight could easily be increased accordingly.

Of secondary benefit is the amount of energy dissipated by flow over the steps formed by the block 10 surface. In general, a stepped surface reduces the energy of the flow at the dam toe compared to a smooth surface. The larger the step height 12, the less the energy remaining in the flow at the toe of the dam. Conversely, as the ratio of the step height 12 to dam height decreases, the energy in the flow increases. The energy remaining in the flow is also a function of the critical flow depth to step height 12 ratio. Data includes a range of critical depths to step height 12 ratios of 3.36 to 15.21. Best results are found within this range. At some point for all flow rates, uniform flow is attained and the energy per foot of width remains constant. When uniform flow is reached, then the velocity and depth will remain constant regardless of the dam height.

If the tailwater elevation and velocities indicate that a hydraulic jump will occur over the blocks, then the blocks should be pinned to restrict rotation caused by the dynamic pressure fluctuations of the jump. Loosely pinned blocks were successfully tested under a hydraulic jump at our facility.

Darcy-Weisbach friction factors are computed based upon velocity profiles, corrected for air concentration. The friction factor, f. varied down the slope, as the flow developed, eventually becoming constant at 0.11 (Manning's n=0.03) for uniform flow. Using this value in a standard step method calculation will determine the flow depths down the chute. An average air concentration of 34% is reached for the fully developed flow condition; therefore, the wall heights should be raised by 34% above the calculated flow depths to contain the flow. An additional safety factor may be added if deemed necessary.

The tapered block system of the invention has been tested well beyond the limits of other concrete revetment systems. The design criteria presented defines their application for a wide range of overtopping. The block system is particularly applicable for dams in remote or environmentally sensitive locations where use of a batch plant or large machinery is limited. The cost of the system will be competitive once the forms have been constructed and the ease of placement discovered.

While the structure shown and described is the preferred embodiment of the invention, it is to be understood that the general structure, arrangement, and combination of parts may be altered by those skilled in the art without departing from the spirit of the invention as defined by the following claims.

What is claimed is:

1. A dam spillway system for embankment dam overtopping protection for a dam embankment, said system comprising:

a layer of free-draining, angular, gravel filter material, and a plurality of rows of overlapping, tapered, concrete blocks assembled over said filter material in shingle-fashion to form steps, from the toe of the dam, up the slope, to the top of the dam, over which water from the top of the embankment flows, said blocks each comprising a projecting portion at the downslope end thereof overlapping an adjacent block and including an end surface defining a step height, a sloping top surface including a step offset area adjacent to the projecting portion of the adjacent upslope block and an impact area against which water flowing from the top of the embankment impacts and a plurality of vents formed in said projecting portion and extending between the undersurface of the block and said end surface of said projecting portion for providing aspiration of uplift pressure from under the block responsive to high velocity flow over the block.

2. The system as claimed in claim 1 further comprising a plurality of fixed concrete toe blocks located at the toe of the dam and supporting each of said rows of concrete blocks.

3. The system as claimed in claim 2 wherein said toe blocks are located beneath the tailwater of the dam.

4. The system as claimed in claim 1 wherein at least some of said concrete blocks are connected together by embedded connecting pins.

5. The system as claimed in claim 1 wherein the slope of said sloping top surface is equal to the embankment slope minus 11°, and the ratio of said step height to the slope of said sloping top surface is between 4 and 6.

6. The system as claimed in claim 5, wherein the percentage of the step height occupied by said vents is 2.8%.

7. A concrete block for use in providing embankment dam overtopping protection, said block including, at the end thereof, a projecting portion extending outwardly from an upper part of the remainder of the block so as to define, together with an end surface of the remainder of the block, a space beneath the projecting portion conforming to the shape of the other end of the block, said projecting portion further including an end surface and an underlying surface, and said block including a plurality of vents defining aspiration ports for said block, each of said vents comprising a channel formed in said end surface of the remainder of the block and the underlying surface of the projecting portion and providing communication between the underside of the block and the end surface of the projecting portion, said block being of generally rectangular shape in plan and being tapered in cross section, said end surface of said projecting portion defining a step height and said block having a sloping upper surface including a step offset area and an impact area.

8. A concrete block as claimed in claim 7 wherein the percentage of the step height of the block occupied by said vents is 2.8%.

9. A dam spillway system for embankment dam overtopping protection for a dam embankment, said system comprising:

a layer of free-draining, angular, gravel filter material, and a plurality of rows of overlapping, tapered, concrete blocks assembled over said filter material in shingle-fashion to form steps, from the toe of the dam, up the slope, to the top of the dam, over which water from the top of the embankment flows, said blocks each comprising a projecting portion at the downslope end thereof overlapping an adjacent block and including an end surface defining a step height, a sloping top surface including a step offset area adjacent to the projecting portion of the adjacent upslope block and an impact area against which water flowing from the top of the embankment impacts and a plurality of vents formed in said projecting portion and extending between the undersurface of the block and said end surface of said projecting portion for providing aspiration of uplift pressure from under the block responsive to high velocity flow over the block, the ratio of said step height to the slope of said sloping top surface being between 4 and 6 and the slope of said sloping top surface being equal to the embankment slope minus 11°; and the plurality of fixed concrete toe blocks located at the toe of the dam for supporting said rows of concrete blocks.

10. A system as claimed in claim 9, wherein said concrete blocks are connected to said toe blocks with embedded connecting pins.

11. A system as claimed in claim 9, wherein the percentage of said step height occupied by said vents is 2.8%.

* * * * *